US007930778B2

(12) United States Patent
Wu et al.

(10) Patent No.: US 7,930,778 B2
(45) Date of Patent: Apr. 26, 2011

(54) PINCH-PREVENTING UNIT FOR BED GUARDRAIL

(75) Inventors: Chia-Sheng Wu, Guanyin Township, Taoyuan County (TW); Chien-Kuo Tsai, Guanyin Township, Taoyuan County (TW)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 11/952,443

(22) Filed: Dec. 7, 2007

(65) Prior Publication Data

US 2009/0144898 A1 Jun. 11, 2009

(51) Int. Cl.
*A47C 21/08* (2006.01)

(52) U.S. Cl. ..... 5/425; 5/424; 5/428; 5/430

(58) Field of Classification Search ..... 5/425, 428, 5/430, 600, 424
See application file for complete search history.

(56) References Cited

U.S. PATENT DOCUMENTS

| | | | |
|---|---|---|---|
| 421,656 | A | 2/1890 | Blanken |
| 993,119 | A | 5/1911 | Stannard |
| 1,398,203 | A | 11/1921 | Schmidt |
| 2,136,088 | A | 11/1938 | Stevens |
| 2,164,484 | A | 7/1939 | Wolfe |
| 2,281,209 | A | 4/1942 | Smith |
| 2,452,366 | A | 10/1948 | Freund |
| 2,556,591 | A | 6/1951 | Loxley |
| 2,564,083 | A | 8/1951 | Stechert |
| 2,587,291 | A | 2/1952 | Rochers |
| 2,605,151 | A | 7/1952 | Shampaine |
| 2,644,173 | A | 7/1953 | James |
| 2,710,976 | A | 6/1955 | Martensen |
| 2,722,017 | A | 11/1955 | Burst et al. |
| 2,766,463 | A | 10/1956 | Bendersky |
| 2,817,854 | A | 12/1957 | Pratt |
| 2,817,855 | A | 12/1957 | Pratt |
| 2,869,614 | A | 1/1959 | Wamsley |
| 2,951,252 | A | 9/1960 | Roche |
| 3,010,121 | A | 11/1961 | Breach |
| 3,018,492 | A | 1/1962 | Rosen |
| 3,021,534 | A | 2/1962 | Hausted |
| 3,053,568 | A | 9/1962 | Miller |
| 3,055,020 | A | 9/1962 | Mann |
| 3,099,440 | A | 7/1963 | Burzlaff |
| 3,112,500 | A | 12/1963 | MacDonald |

(Continued)

FOREIGN PATENT DOCUMENTS

DE 199 00 602 C1 7/2000

(Continued)

OTHER PUBLICATIONS

Paramount Bed Product Brochure, date unknown.

(Continued)

*Primary Examiner* — Robert G Santos
*Assistant Examiner* — Brittany M Wilson
(74) *Attorney, Agent, or Firm* — Barnes & Thornburg, LLP

(57) ABSTRACT

A pinch-preventing unit for bed guardrail includes a guardrail, a bed frame, and an actuating unit. The actuating unit is provided with a gap cover, which is located at a lower edge of the guardrail to close a gap existed between the lower edge of the guardrail and a top of the bed frame when the guardrail is in a lifted position for use, so as to ensure the safety use of the guardrail.

9 Claims, 6 Drawing Sheets

U.S. PATENT DOCUMENTS 3,138,805 A 6/1964 Piazza
3,148,387 A 9/1964 Sarnie et al.
3,210,779 A 10/1965 Herbold
3,220,021 A 11/1965 Nelson
3,220,022 A 11/1965 Nelson
3,233,255 A 2/1966 Propst
3,239,853 A 3/1966 MacDonald
3,249,387 A 5/1966 Pivacek
3,256,533 A 6/1966 Michelsen
3,309,717 A 3/1967 Black
3,321,779 A 5/1967 Kaufman et al.
3,344,445 A 10/1967 Crawford
3,351,962 A 11/1967 Dodrill et al.
3,406,772 A 10/1968 Ahrent et al.
3,456,269 A 7/1969 Goodman
3,486,176 A 12/1969 Murcott
3,585,659 A 6/1971 Burst et al.
3,593,350 A 7/1971 Knight et al.
3,619,824 A 11/1971 Doyle
3,640,566 A 2/1972 Hodge
3,742,530 A 7/1973 Clark
3,845,511 A 11/1974 Benoit et al.
3,851,345 A 12/1974 Benoit et al.
3,865,434 A 2/1975 Sully
3,877,090 A 4/1975 Schutz
3,893,197 A 7/1975 Ricke
3,897,973 A 8/1975 Long et al.
3,905,591 A 9/1975 Schorr et al.
3,916,461 A 11/1975 Kerstholt
3,971,083 A 7/1976 Peterson
4,127,906 A 12/1978 Zur
4,139,917 A 2/1979 Fenwick
4,168,099 A 9/1979 Jacobs et al.
4,183,015 A 1/1980 Drew et al.
4,186,456 A 2/1980 Huempfner
4,214,326 A 7/1980 Spann
4,215,446 A 8/1980 Mahoney
4,232,415 A 11/1980 Webber
4,240,169 A 12/1980 Roos
4,258,445 A 3/1981 Zur
4,312,500 A 1/1982 Janssen
4,336,621 A 6/1982 Schwartz et al.
4,370,765 A 2/1983 Webber
4,409,695 A 10/1983 Johnston et al.
4,439,880 A 4/1984 Koncelik et al.
4,453,732 A 6/1984 Assanah et al.
D276,112 S 10/1984 Ferrell et al.
4,557,471 A 12/1985 Pazzini
4,607,402 A 8/1986 Pollard
4,612,679 A 9/1986 Mitchell
4,653,129 A 3/1987 Kuck et al.
4,654,903 A 4/1987 Chubb et al.
4,670,923 A 6/1987 Gabriel et al.
4,672,698 A 6/1987 Sands
4,675,926 A 6/1987 Limdblom et al.
4,676,687 A 6/1987 Koffler
4,685,159 A 8/1987 Oetiker
4,704,750 A 11/1987 Wheelock
4,710,049 A 12/1987 Chang
4,710,992 A 12/1987 Falwell
4,745,647 A 5/1988 Goodwin
4,747,171 A 5/1988 Einsele et al.
4,751,754 A 6/1988 Bailey et al.
4,767,419 A 8/1988 Fattore
4,768,249 A 9/1988 Goodwin
4,783,864 A 11/1988 Turner
4,800,600 A 1/1989 Baum
4,827,545 A 5/1989 Arp
4,839,933 A 6/1989 Plewright et al.
4,847,929 A 7/1989 Pupovic
4,858,260 A 8/1989 Failor et al.
4,862,529 A 9/1989 Peck
4,862,530 A 9/1989 Chen
4,872,228 A 10/1989 Bishop
4,873,734 A 10/1989 Pollard
4,894,876 A 1/1990 Fenwick
4,944,055 A 7/1990 Shainfeld
4,974,905 A 12/1990 Davis
4,985,946 A 1/1991 Foster et al.
4,993,089 A 2/1991 Solomon et al.
5,010,611 A 4/1991 Mallett
5,035,014 A 7/1991 Blanchard
5,040,253 A 8/1991 Cheng
5,044,025 A * 9/1991 Hunsinger et al. ..... 5/424
5,060,327 A 10/1991 Celestina et al.
5,072,463 A 12/1991 Willis
5,077,843 A 1/1992 Foster et al.
5,083,332 A 1/1992 Foster et al.
5,083,334 A 1/1992 Huck et al.
5,084,925 A 2/1992 Cook
5,097,550 A 3/1992 Marra
5,129,117 A 7/1992 Celestina et al.
5,175,897 A 1/1993 Marra
5,179,744 A 1/1993 Foster et al.
5,191,663 A 3/1993 Holder et al.
5,193,633 A 3/1993 Ezenwa
5,197,156 A 3/1993 Stryker et al.
5,205,004 A 4/1993 Hayes et al.
D336,577 S 6/1993 Celestina et al.
5,216,768 A 6/1993 Bodine et al.
5,230,113 A 7/1993 Foster et al.
5,279,010 A 1/1994 Ferrand et al.
5,365,623 A 11/1994 Springer
5,381,571 A 1/1995 Gabhart
5,384,927 A 1/1995 Mardero et al.
5,410,765 A 5/1995 Youngblood
5,418,988 A 5/1995 Iura
5,421,046 A 6/1995 Vande Streek
5,450,641 A 9/1995 Montgomery
5,454,126 A 10/1995 Foster et al.
5,455,973 A 10/1995 Brumfield et al.
5,479,666 A 1/1996 Foster et al.
5,481,772 A 1/1996 Glynn et al.
5,485,699 A 1/1996 Gabhart
5,524,306 A 6/1996 George
5,537,701 A 7/1996 Elliott
5,542,135 A 8/1996 Ozrovitz et al.
5,557,817 A 9/1996 Haddock
5,575,025 A 11/1996 Peters
5,577,277 A 11/1996 Sundberg et al.
5,577,279 A 11/1996 Foster et al.
5,642,545 A 7/1997 Howard
5,671,490 A 9/1997 Wu
5,678,267 A 10/1997 Kinder
5,689,839 A 11/1997 Laganiere et al.
5,715,548 A 2/1998 Weismiller et al.
5,732,423 A 3/1998 Weismiller et al.
5,745,937 A 5/1998 Weismiller et al.
5,749,112 A 5/1998 Metzler
5,761,756 A 6/1998 Nowak et al.
5,771,506 A 6/1998 Joiner
5,781,945 A 7/1998 Scherer et al.
5,802,636 A 9/1998 Corbin et al.
5,832,549 A 11/1998 Le Pallec et al.
5,864,900 A 2/1999 Landau
5,878,452 A 3/1999 Brooke et al.
5,926,873 A 7/1999 Fountain
5,987,666 A 11/1999 Zigmont
6,038,721 A 3/2000 Gordon
6,058,531 A 5/2000 Carroll
6,089,593 A 7/2000 Hanson et al.
6,347,422 B2 2/2002 Heavrin
6,374,440 B1 4/2002 Thim, Jr.
6,397,416 B2 6/2002 Brooke et al.
6,401,277 B1 6/2002 Savage et al.
6,401,281 B1 6/2002 Younge
6,427,264 B1 8/2002 Metz et al.
6,430,766 B1 8/2002 Henley et al.
6,615,426 B1 * 9/2003 Risk, Jr. ..... 5/425
7,028,352 B2 * 4/2006 Kramer et al. ..... 5/425
7,073,220 B2 * 7/2006 Simmonds et al. ..... 5/428
7,472,446 B2 * 1/2009 Parker ..... 5/663
2002/0144348 A1 * 10/2002 Ganance ..... 5/600
2003/0093860 A1 5/2003 Kramer et al.
2004/0040092 A1 * 3/2004 Hensley et al. ..... 5/600
2004/0172753 A1 * 9/2004 Metz et al. ..... 5/425
2008/0005836 A1 * 1/2008 Kawaguchi et al. ..... 5/425

FOREIGN PATENT DOCUMENTS

| | | | |
|---|---|---|---|
| EP | 0 037 063 | A2 | 10/1981 |
| FR | 1450817 | | 8/1966 |
| GB | 1466080 | | 3/1977 |
| GB | 2313303 | | 11/1997 |
| WO | WO 98/17153 | | 4/1998 |
| WO | WO 99/15126 | | 4/1999 |

OTHER PUBLICATIONS

Hill-Rom Med Surg Bed Accessories, 1997.

Paramount Bed Product Brochure, date unknown (63 pages).

Hill-Rom Med Surg Bed Accessories, 1997, (6 pages).

* cited by examiner

PINCH-PREVENTING UNIT FOR BED GUARDRAIL

FIELD OF THE INVENTION

The present invention relates to a pinch-preventing unit for bed guardrail, and more particularly to a bed guardrail unit being provided with a gap cover to close a gap existed between a bed frame and a lifted guardrail.

BACKGROUND OF THE INVENTION

To prevent a patient or a small child from unconsciously turning sideward and falling from a bed, guardrails have been designed and added to two lateral sides of the bed. In designing a bed guardrail, not only for a sickbed in a hospital or a stretcher on an ambulance, but also for a bed used in home, it is a must to ensure the guardrail is safe for a user. The guardrail for bed must satisfy a required safety coefficient, lest it should cause second injury or even death to a patient or child using the bed. That is, the guardrail for bed, particularly sickbed and stretcher, must be designed in consideration of the user's comfortableness, safety, and convenient operation.

However, the guardrail tends to form a hindrance to doctors and nurses in the process of emergent medical care and setting life support, or to the patient's family members in helping the patient in turning sideward, cleaning body, etc. Therefore, it has become an important issue to design a mechanism for smoothly and safely lifting or lowering the guardrail relative to a bed frame. For a guardrail to have sufficient space for smooth operation thereof, a quite large gap would frequently exist between the lifted guardrail and the bed frame. Such large gap tends to dangerously pinch the patient's or the small child's hand or neck, and needs improvement.

It is therefore tried by the inventor to develop a pinch-preventing unit for bed guardrail to effectively eliminate the drawbacks in the bed guardrail of prior art.

SUMMARY OF THE INVENTION

A primary object of the present invention is to provide a bed guardrail mechanism that enables reduced gap between a guardrail and a bed frame by adding a gap cover to the guardrail, so as to ensure the safety of a user of the guardrail.

Another object of the present invention is to provide a simple and convenient bed guardrail elevating mechanism, so that a bed guardrail could be smoothly moved between a lowered position and a lifted position, and the guardrail at the lowered position has a lower edge located above a floor surface by a distance no less than 120 mm to prevent an operator's feet from being injured by the lowered guardrail, and the guardrail at the lifted position has a lower edge located above the top of the bed frame smaller than 60 mm to prevent a user's hand or neck from being dangerously pinched between the guardrail and the bed frame.

To achieve the above and other objects, a pinch-preventing unit for bed guardrail is provided by the present invention to include a guardrail, a gap cover, an actuating unit, and a bed frame.

The actuating unit includes an operating plate for locking and unlocking the actuating unit. The operating plate has a hooking portion. The actuating unit also includes a hook, which has an upper and a lower hooked end. When the hooking portion of the operating plate is hooked to the upper hooked end of the hook, and the lower hooked end of the hook is hooked to the bed frame, the actuating unit is in a locked state. On the other hand, when the operating plate is operated to force the lower hooked end of the hook to separate from the bed frame, the actuating unit is unlocked and a pivotal arm of the actuating unit could be upward turned by 180 degrees to lift the guardrail connected to an upper end of the pivotal arm. The gap cover is pivotally connected to an upper end of the actuating unit to close a gap existed between a lower edge of the lifted guardrail and the top of the bed frame, so that any gap between the guardrail and the bed frame is always limited to be smaller than 60 mm without the risk of pinching a user's hand or neck. When the actuating unit is operated to lower down the guardrail, the lower edge of the lowered guardrail is distant from the floor surface no less than 120 mm without the risk of colliding with the floor surface or an operator's feet.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
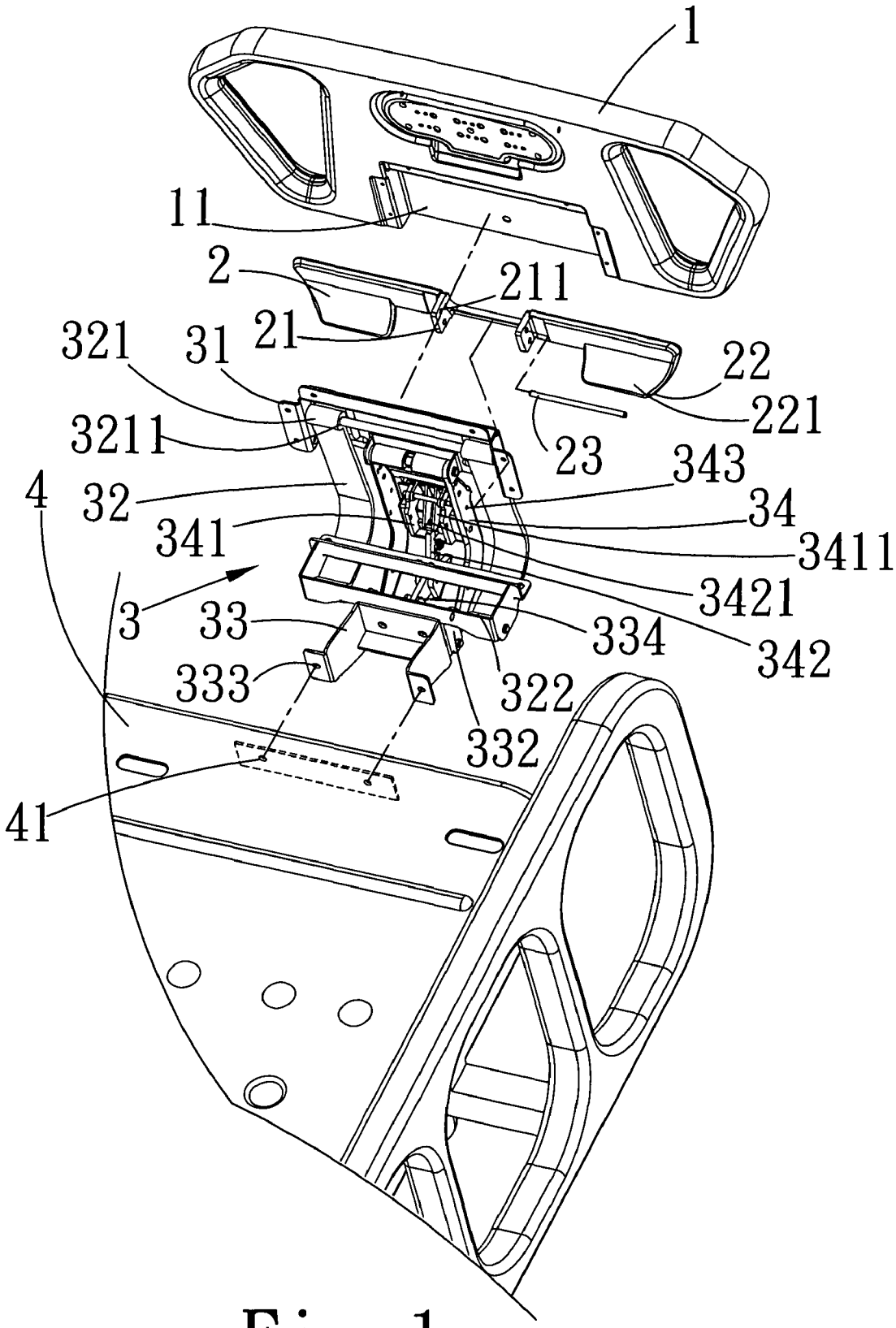
FIG. 1 is an exploded perspective view of a pinch-preventing unit for bed guardrail according to a preferred embodiment of the present invention.

Please refer to FIG. 1 that is an exploded perspective view of a pinch-preventing unit for bed guardrail according to a preferred embodiment of the present invention. As shown, the pinch-preventing unit for bed guardrail includes a guardrail 1, a gap cover 2, an actuating unit, and a bed frame 4.

The guardrail 1 is provided on an inner lower side facing toward the bed frame 4 with a recess 11.

The actuating unit 3 is provided at an upper end with an upper mounting bracket 31 for fixedly mounting to the recess 11 to thereby connect the guardrail 1 to the actuating unit 3, and at a lower end with a lower mounting bracket 33 having mounting holes 333 formed thereon. By aligning the mounting holes 333 with holes 41 correspondingly provided on the bed frame 4 and threading fastening elements through the aligned mounting holes 333 and holes 41, the guardrail 1 and the gap cover 2 connected to the actuating unit 3 may be movably attached to the bed frame 4.

The actuating unit 3 includes a pivotal arm 32, an upper and a lower end of which are respectively provided with a round bar 321, 322. The round bar 321 has a shaft hole 3211 axially extended a full length of the round bar 321. The pivotal arm 32 is pivotally connected at the upper end to the upper mounting bracket 31 via the round bar 321, and pivotally connected at the lower end to a lug 332 on the lower mounting bracket 33 via the round bar 322.

The actuating unit 3 also includes a locking mechanism 34, an upper and a lower end of which are pivotally connected to the upper and the lower mounting bracket 31, 33, respectively. The locking mechanism 34 includes an operating plate 341 having a hooking portion 3411, and a hook 342 provided at upper and lower ends with a hooked end 3421 each. When the hook 342 is hooked at the upper hooked end 3421 to the hooking portion 3411 of the operating plate 34 and at the lower hooked end 3421 to a hook portion 334 on the lower mounting bracket 33, the locking mechanism 34 is in a locked state. By controlling the operating plate 341, the hooking portion 3411 thereof may be caused to force the upper hooked end 3421 of the hook 342 to move downward, so that the lower hooked end 3421 of the hook 342 is separated from the hook portion 334 on the lower mounting bracket 33 and accordingly, the bed frame 4. At this point, the locking mechanism 34 is in an unlocked state.

The gap cover 2 is provided on an inner side with at least one lug 21, on which a through hole 211 is formed. By extending an insertion pin 23 through the through hole 211 on the lug 21 of the gap cover 2 and two pin holes 343 correspondingly formed on the locking mechanism 34, the gap cover 2 may be connected to the locking mechanism 34.

Figure 2:
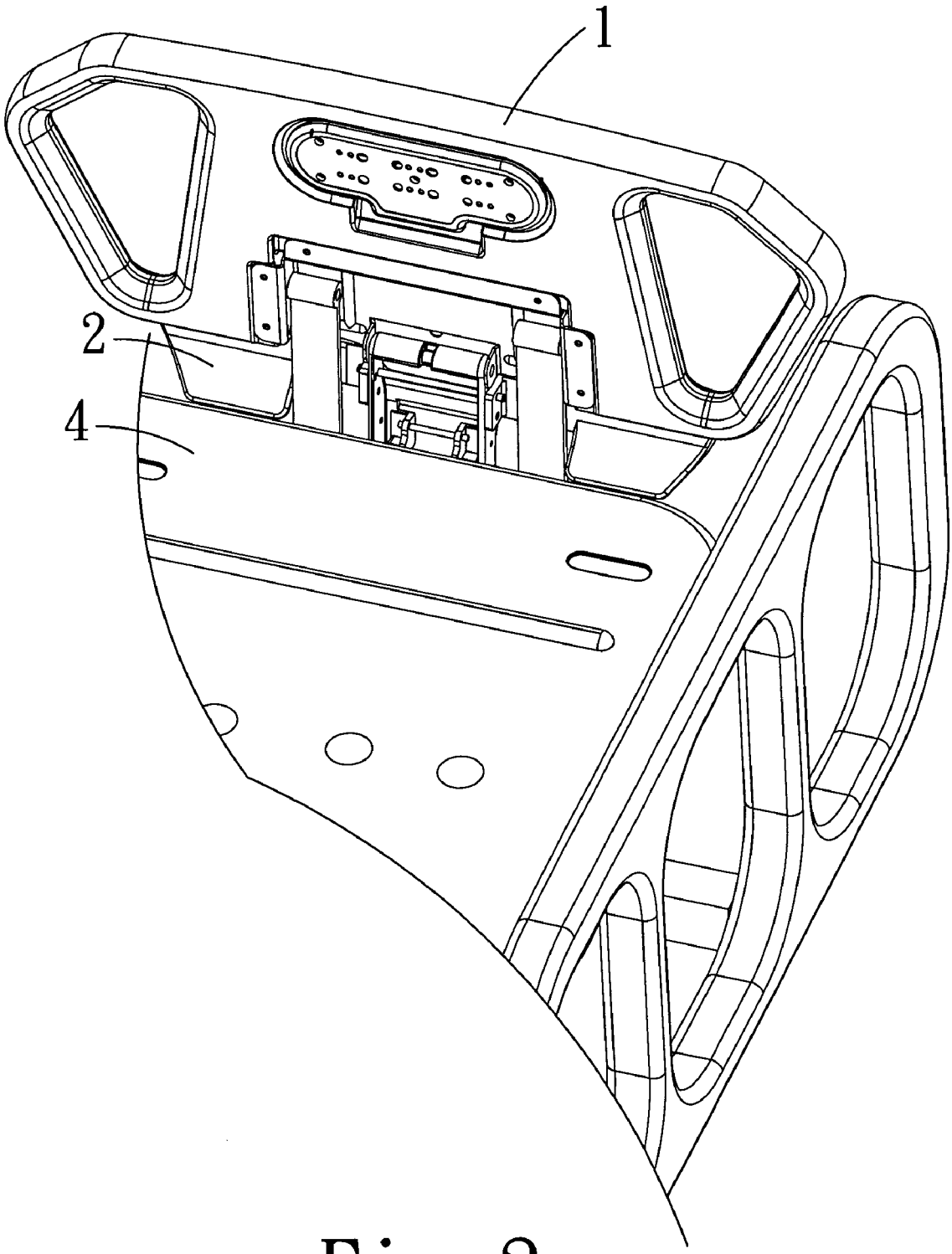
FIG. 2 is an assembled view of FIG. 1.

Please refer to FIG. 2 that is an assembled view of FIG. 1. As can be clearly seen from FIG. 2, the gap cover 2 is located between a lower edge of the guardrail 1 and a top of the bed frame 4. With the gap cover 2, a gap between the lower edge of the guardrail 1 and the top of the bed frame 4 may be controlled to be less than 60 mm. Therefore, the risk of having an excessively large gap between the lower edge of the guardrail 1 and the bed frame 4 may be avoided.

Figure 3:
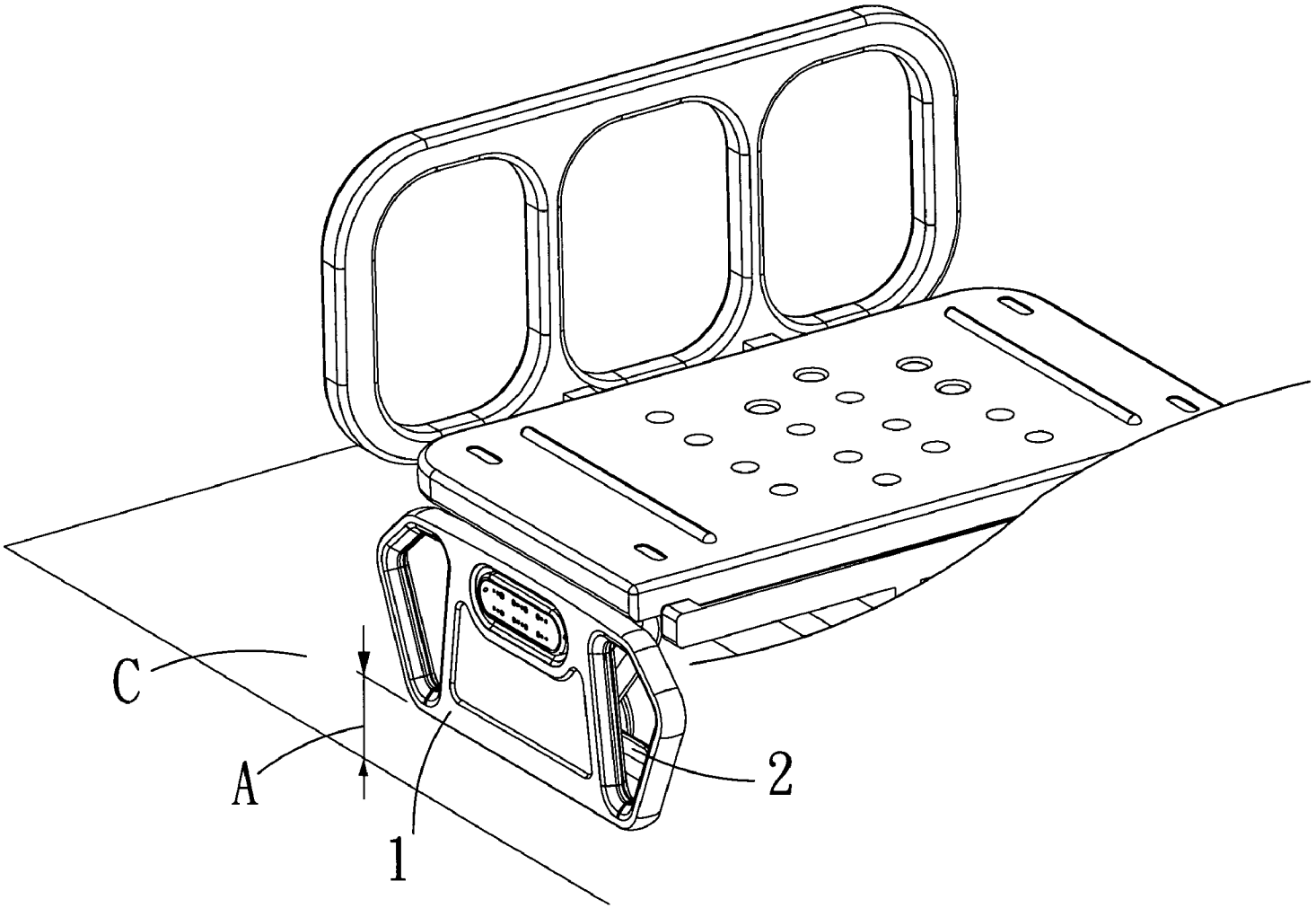
FIG. 3 is a perspective view showing the pinch-preventing unit for bed guardrail according to the preferred embodiment of the present invention in a lowered position.
Figure 4:
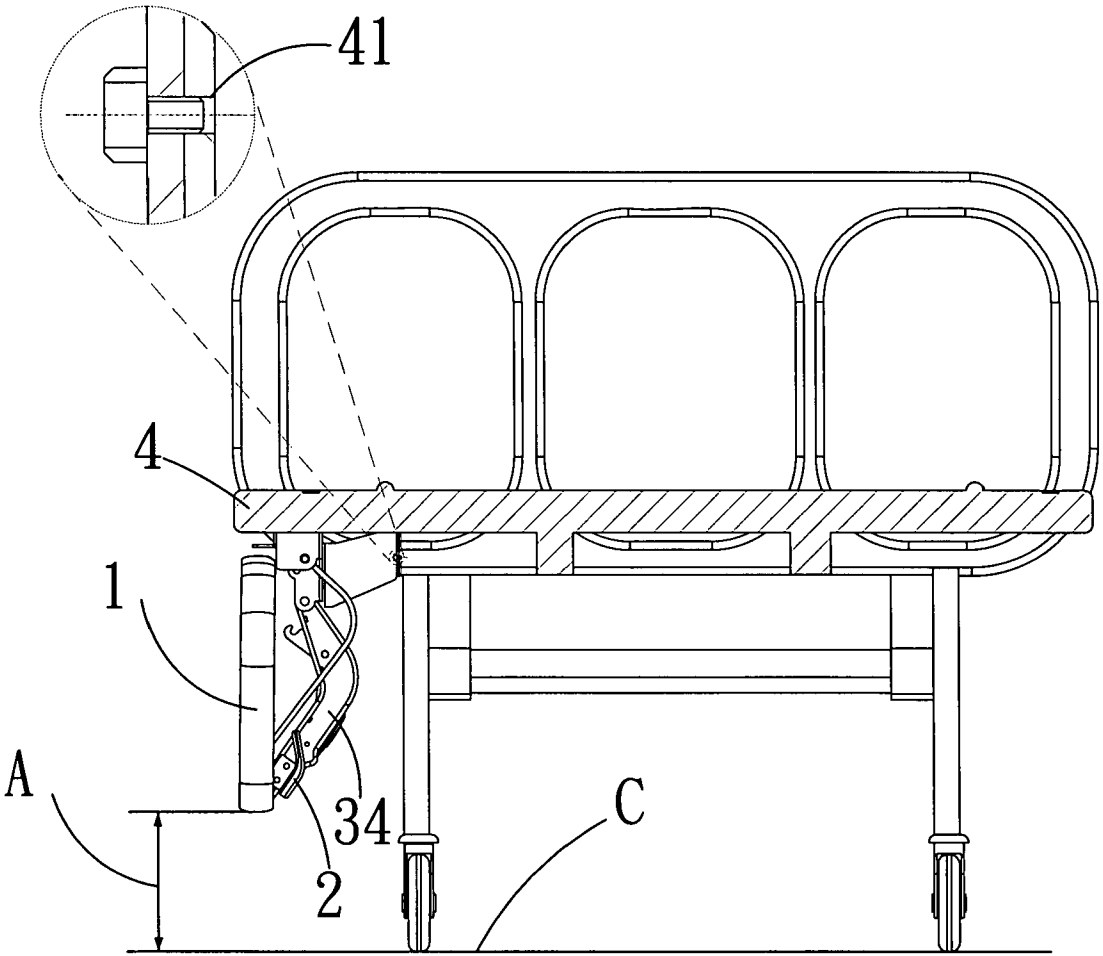
FIG. 4 is a side view of FIG. 3.

Please refer to FIGS. 3 and 4 that are perspective and side views, respectively, showing the pinch-preventing unit for bed guardrail according to the preferred embodiment of the present invention is pivotally turned to a lowered position. In this position, the guardrail 1 and the gap cover 2 are located at a position lower than the top of the bed frame 4 with the gap cover 2 pivotally turned toward the inner lower side of the guardrail 1, so that a distance A no less than 120 mm is existed between the lower edge of the lowered guardrail 1 and a floor surface C to satisfy the requirement specified by related safety code. With the distance A, the guardrail 1 and the gap cover 2 during the operation thereof are prevented from colliding with the floor surface C to produce interference or colliding with an operator's feet to injure the operator.

Figure 5:
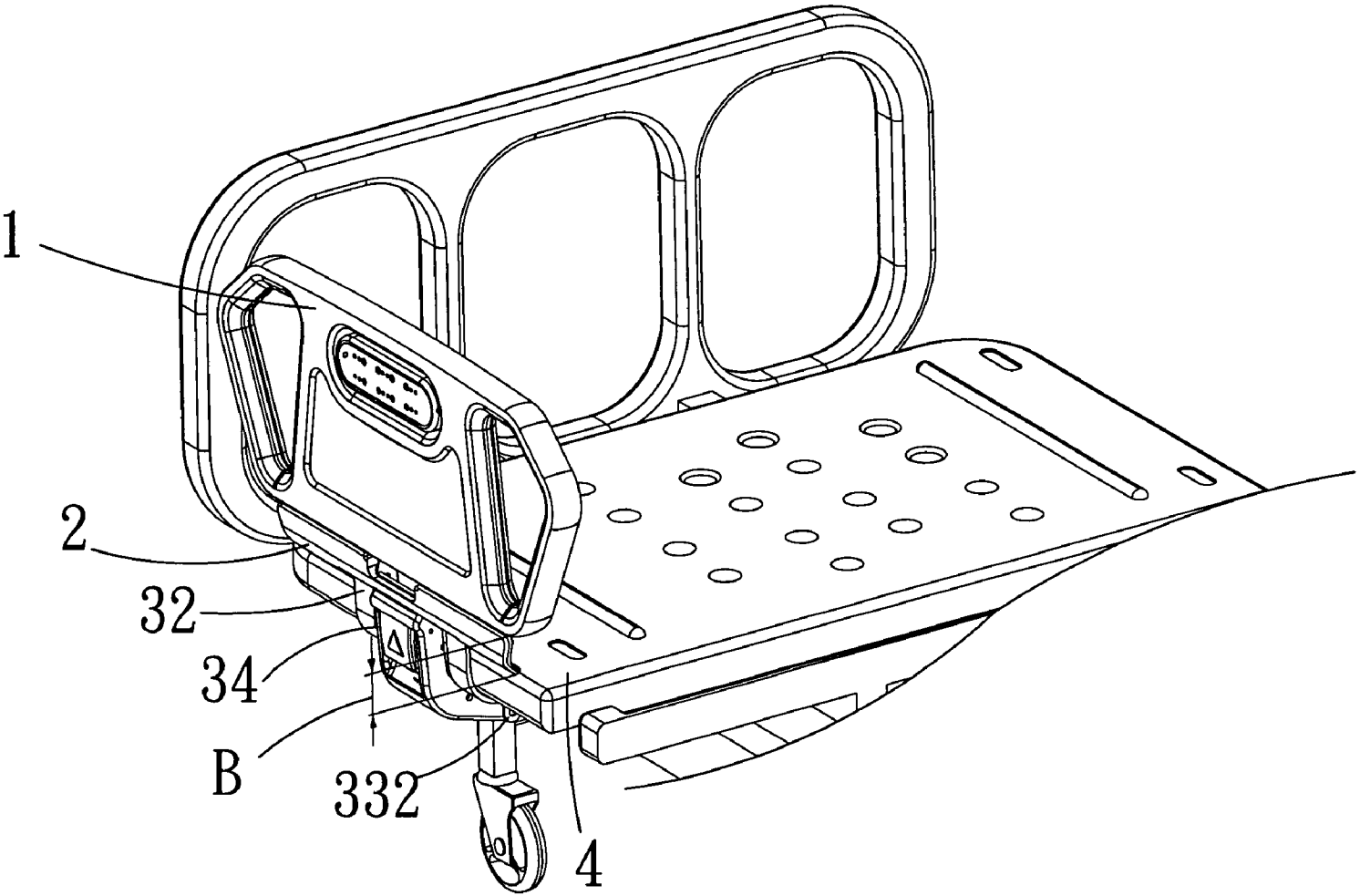
FIG. 5 is a perspective view showing the pinch-preventing unit for bed guardrail according to the preferred embodiment of the present invention in a lifted position.
Figure 6:
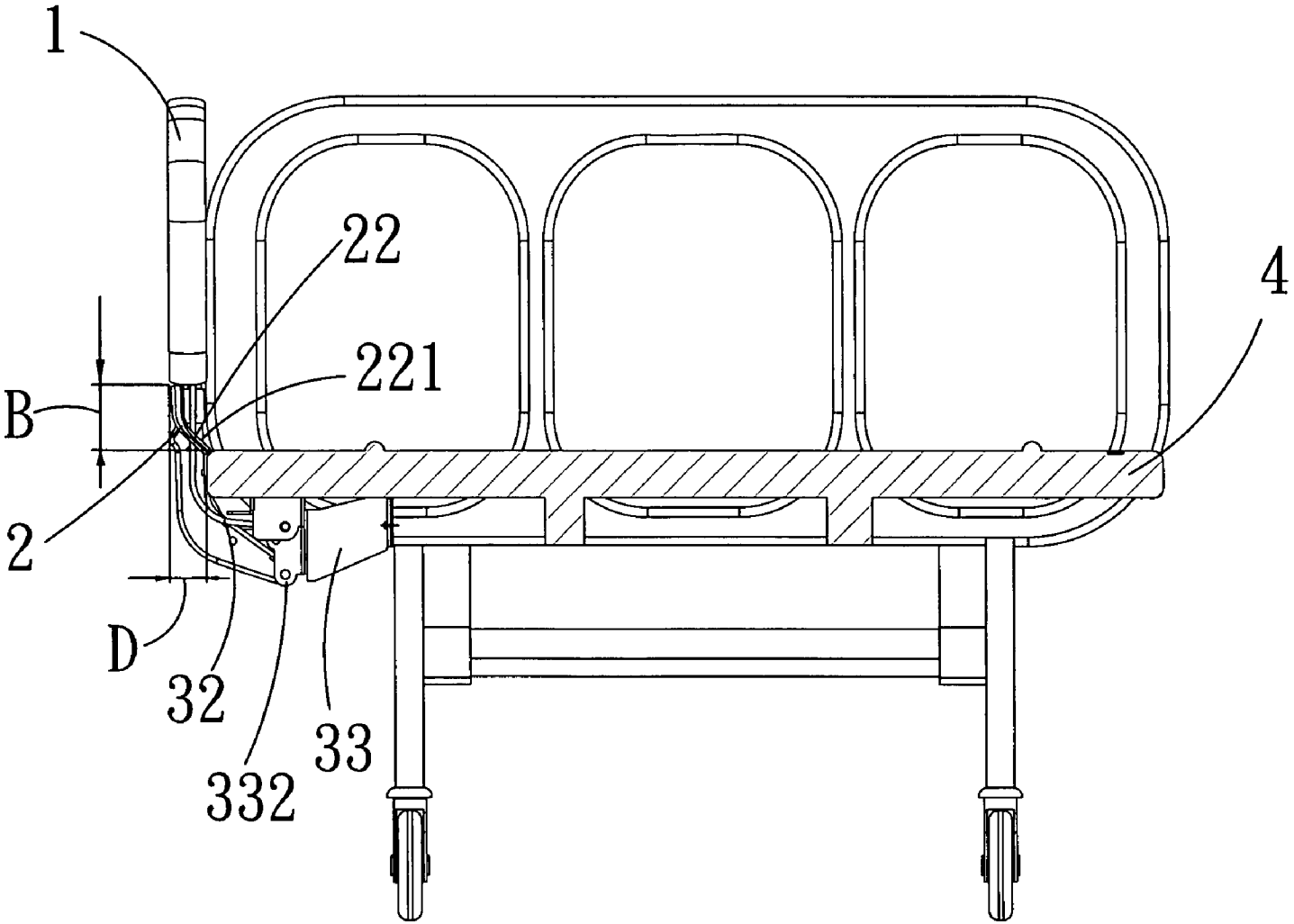
FIG. 6 is a side view of FIG. 5.

Please refer to FIGS. 5 and 6 that are perspective and side views, respectively, showing the pinch-preventing unit for bed guardrail according to the preferred embodiment of the present invention is pivotally turned to a lifted position. To do this, first unlock the actuating unit 3, and the pivotal arm 32 is pivotally upward turned about the lug 332 on the lower mounting bracket 33 by 180 degrees until the pivotal arm 32 is moved to locate above the lug 332. At this point, the lower hooked end 3421 of the hook 342 in the locking mechanism 34 would hook to the lower mounting bracket 33, as shown in FIG. 1, so that the actuating unit 3 is locked and the guardrail 1 is lifted and held in place to locate above the lug 332, and a gap B between the lower edge of the lifted guardrail 1 and the top of the bed frame 4 is closed by the gap cover 2. It is noted there is a transverse gap D existed between a lower outer side of the lifted guardrail 1 and a lateral outer side of the bed frame 4. However, the gap cover 2 has a lower part 22 formed into a downward curved surface 221, which is extended from the lower edge of the guardrail 1 toward the top of the bed frame 4 to also properly close the gap D between the lifted guardrail 1 and the bed frame 4 and thereby solve the problem of an excessively large gap D.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A bed comprising a frame, a guardrail, an actuating unit coupling the guardrail to the frame for movement between a raised position in which the guardrail is above the frame and a lowered position in which the guard unit is below the frame, the actuating unit having at least one arm that pivots relative to the guardrail and relative to the frame to guide the movement of the guardrail between the raised and lowered positions, and a gap cover fastened to the actuating unit to pivot therewith as the guardrail is moved between the raised and lowered positions, the gap cover including end portions extending in opposite directions beyond the actuating unit, the gap cover being situated underneath the guardrail when the guardrail is in the raised position to substantially close a horizontally extending gap located between a lower edge of the guardrail and a top of the frame.

2. The bed of claim 1, wherein the end portions of the gap cover include curved portions that curve toward the frame when the guardrail is in the raised position.

3. The bed of claim 2, wherein the at least one arm of the actuating unit comprises a pair of spaced apart arms, a space is defined between the curved portions of the gap cover, and portions of each of the pair of spaced apart arms are received in the space when the guardrail is in the raised position.

4. The bed of claim 3, wherein the pair of spaced apart arms are situated outside the space when the guardrail is in the lowered position.

5. The bed of claim 1, wherein the actuating unit includes a locking unit and the gap cover is fastened to the locking unit.

6. The bed of claim 5, wherein the gap cover has at least one lug and the gap cover is fastened to the locking unit by a pin that extends through a first opening in the lug and a second opening in the locking unit.

7. The bed of claim 6, wherein the at least one lug of the gap cover comprises a pair of spaced apart lugs and a portion of the locking unit is situated between the pair of spaced apart lugs.

8. The bed of claim 7, wherein the at least one arm of the actuating unit comprises a pair of spaced apart arms and each lug of the pair of lugs is situated between the locking unit and a corresponding one of the pair of spaced apart arms.

9. The bed of claim 6, wherein the pin extends parallel with the axes about which the at least one arm pivots relative to the guardrail and the frame.

* * * * *